US010745944B2

(12) United States Patent
Bendel et al.

(10) Patent No.: US 10,745,944 B2
(45) Date of Patent: Aug. 18, 2020

(54) MOTOR VEHICLE DOOR LOCK

(71) Applicant: Kiekert Aktiengesellschaft, Heiligenhaus (DE)

(72) Inventors: Thorsten Bendel, Oberhausen (DE); Michael Scholz, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 959 days.

(21) Appl. No.: 15/024,419

(22) PCT Filed: Sep. 9, 2014

(86) PCT No.: PCT/DE2014/100321
§ 371 (c)(1),
(2) Date: Jun. 15, 2016

(87) PCT Pub. No.: WO2015/043575
PCT Pub. Date: Apr. 2, 2015

(65) Prior Publication Data

US 2016/0281394 A1 Sep. 29, 2016

(30) Foreign Application Priority Data

Sep. 27, 2013 (DE) ..... 10 2013 110 756

(51) Int. Cl.
*E05B 77/06* (2014.01)
*E05B 81/06* (2014.01)

(52) U.S. Cl.
CPC ..... *E05B 77/06* (2013.01); *E05B 81/06* (2013.01)

(58) Field of Classification Search
CPC ..... E05B 77/06; E05B 81/06
See application file for complete search history.

(56) References Cited

U.S. PATENT DOCUMENTS

2011/0254287 A1* 10/2011 Akizuki ..... E05B 77/06 292/223
2012/0110920 A1 5/2012 Takagi et al.
(Continued)

FOREIGN PATENT DOCUMENTS

DE 102 20 786 B3 3/2004
DE 103 27 450 A1 1/2005
(Continued)

OTHER PUBLICATIONS

Machine Translation of DE102010049393A1 by Lexis Nexis Total Patent on Apr. 21, 2016.
(Continued)

*Primary Examiner* — Kristina R Fulton
*Assistant Examiner* — Thomas L Neubauer
(74) *Attorney, Agent, or Firm* — Woodard, Emhardt, Henry, Reeves & Wagner, LLP

(57) ABSTRACT

The invention relates to a motor vehicle door lock equipped with a locking mechanism, an actuation lever mechanism acting on said locking mechanism, and a locking element. The locking element disables the actuation lever mechanism when accelerating forces of a defined magnitude occur, for example in the event of an accident. According to the invention the locking element is a transmission lever which can be impinged upon by a locking unit and is located between the actuation lever mechanism and the locking mechanism.

17 Claims, 10 Drawing Sheets

(56) References Cited

U.S. PATENT DOCUMENTS

| | | | |
|---|---|---|---|
| 2012/0175896 | A1 | 7/2012 | Martinez |
| 2013/0015670 | A1 | 1/2013 | Perkins |
| 2014/0346786 | A1 | 11/2014 | Takagi et al. |

FOREIGN PATENT DOCUMENTS

| | | | |
|---|---|---|---|
| DE | 103 32 446 | A1 | 2/2005 |
| DE | 103 36 418 | A1 | 3/2005 |
| DE | 102010049393 | A1 | 4/2012 |
| EP | 2133496 | A2 | 12/2009 |
| WO | 2013/046317 | A1 | 4/2013 |

OTHER PUBLICATIONS

Machine Translation of EP2133496A2 by Lexis Nexis Total Patent on Apr. 21, 2016.
Written Opinion dated Jan. 16, 2015 in related PCT/DE2014/100321.
German Office Action issued in related DE102013110756.7 dated Oct. 6, 2014.
Machine translation of DE10220786B3 on Aug. 2, 2019 by Patent Translate European Patent Office (pp. 12).
Machine translation of DE10327450A1 on Aug. 2, 2019 by Patent Translate European Patent Office (pp. 21).
Machine translation of DE10332446A1 on Aug. 2, 2019 by Patent Translate Euroopean Patent Office (pp. 15).
Machine translation of DE10336418A1 on Aug. 2, 2019 by Patent Translate European Patent Office (pp. 22).

* cited by examiner

MOTOR VEHICLE DOOR LOCK

BACKGROUND

The invention relates to a motor vehicle door latch, with a locking mechanism, furthermore with an activation lever system working on the locking mechanism, and with a locking element, which disables the activation lever system when acceleration forces of a specified magnitude occur, for example in the event of an accident.

Diverse types of motor vehicle locking systems or motor vehicle door latches due to centrifugal forces or relevant mass locks are known. Fundamentally, it involves preventing unintentional opening of the motor vehicle door equipped with the relevant motor vehicle door latch in the case of severe accelerations, as may occur in the event of an accident. Only thus can it be ensured that the passengers in the motor vehicle receive maximum protection and, for example, safety devices such as lateral airbags, etc. are activated accurately in the motor vehicle door.

In practice, a distinction is made between active and passive systems. Active systems are characterized by a movement occurring both for severe and slight acceleration of the latch kinematics or the motor vehicle door latch and in particular the activation lever system in order to attain safe functionality over the entire lifetime. On the contrary, passive systems only react in the case of unusually severe acceleration, i.e. in the case of accident.

All previously known centrifugal force or mass locks for the prevention of unintentional door opening in the event of a crash require additional components which increase the weight of the motor vehicle door and the cost. Thus, for example, within the scope of EP 2 133 496 A2 the pertaining external door handle is equipped with a pivotable locking element acting as a mass lock.

A corresponding handle can only be activated in a release position of the mass lock or the pivotable locking element. On the contrary, the handle is blocked in the case of a crash. The necessary and relatively complex locking element not only increases the mass of the known external door handle significantly, but considerable costs are also associated with it.

Although the class-specific state of the art in accordance with DE 10 2010 049 393 A1 also works with an additional locking element, this engages the locking mechanism directly and can consequently be of a compact and small construction. Furthermore, the activation lever system is not touched. Consequently, its functional safety is not impaired. However, an especially robust locking element is used which increases the weight of the known motor vehicle door latch overall.

It is therefore important overall not only to maintain the functional safety of the locking element throughout the entire lifetime of the motor vehicle door latch, but in the previous state of the art ultimately no convincing solutions have been provided which combine the opposing requirements of functional safety in conjunction with a light weight and reduced costs. Added to this is the fact that partly statutory requirements prescribe that the crash must be kept under control with the motor vehicle door latch in its unbolted state in particular. This is where the invention is used.

SUMMARY

The invention is based on the technical problem of further developing a motor vehicle door latch of the construction described at the start in such a way that costs and weight are reduced compared to previous designs with impeccable functionality.

In order to solve this technical problem, a class-specific motor vehicle door latch in accordance with the invention is characterized in that the locking element is formed as a transfer lever impingeable by a bolting unit between the activation lever system and the locking mechanism.

In detail, work can take place in such a way that the bolting unit works on the transfer lever by means of a coupling lever. The transfer lever is generally in its "bolted" position.

For this reason the design is furthermore such that the bolting unit blocks the transfer lever mechanically in the "bolted" position. The coupling lever serves this purpose.

This means that the "bolted" functional setting of the motor vehicle door latch in accordance with the invention is typically implemented and executed in such a way that the transfer lever usually in its "bolted" position anyway is mechanically blocked with the aid of the bolting unit in this "bolted" position. Any movements of the transfer lever for opening of the locking mechanism are consequently not possible in this "bolted" position.

In contrast, the "unbolted" position corresponds to the bolting unit and consequently the motor vehicle door latch in accordance with the invention overall that the bolting unit enables a freewheel for the transfer lever in the relevant "unbolted" position. This means that in order to achieve the "unbolted" functional setting, the bolting unit or the coupling lever impinged by the bolting unit is mechanically propelled in such a way that the transfer lever can execute a freewheel vis-à-vis the coupling lever. In contrast, the relevant coupling lever ensures that the transfer lever is blocked in the "bolted" position.

As already explained, the transfer lever assumes the "bolted" position as the basic setting or rest setting. The consequence of this is that a so-called normal activation initially transfers the transfer lever into its "unbolted" position with the aid of the activation lever system. Hereby the transfer lever is coupled with the activation lever system. The further movement of the activation lever system with this normal activation now opens up the possibility of the pawl being directly or indirectly raised from the catch as a component of the locking mechanism with the aid of the transfer lever. This means that during normal activation the transfer lever ensures opening of the locking mechanism. A scheduled movement of the locking element or the transfer lever in accordance with the invention corresponds to this, consequently, hardenings, corrosions, etc. are not to be feared. Instead, the durable functional safety of the transfer lever is guaranteed.

The circumstance that the transfer lever can be transferred from its "unbolted" position to its "bolted" position for example with the aid of the bolting unit also contributes to this. To this end, the bolting unit works mechanically on the coupling lever which pivots the transfer lever. A regular activation of the locking element or the transfer lever in accordance with the invention is also ensured as a result. The bolting unit can basically involve a central bolting unit.

In the case of a crash, the activation lever system accomplishes an idling vis-à-vis the transfer lever. This means that in the case of a crash the transfer lever remains in its "bolted" functional position. It therefore does not come about that the activation lever system and the transfer lever are mechanically connected by means of the coupling located between them. Instead, in the case of a crash the transfer lever retains its position, whereas the activation lever system pivots. As a consequence hereof, the transfer lever can also not open the locking mechanism directly or indirectly and consequently accomplishes the desired locking effect.

As already explained, during normal activation—contrary to the case of the crash—the activation lever system transfers the transfer lever into the "unbolted" position to open the locking mechanism. At the same time, during this normal activation the activation lever system is coupled with the transfer lever or the transfer lever is coupled vis-à-vis the activation lever system. Thus, the activation lever system can work mechanically on the transfer lever and ultimately ensure during further activation that the locking mechanism is directly or indirectly opened with the aid of the pivoted transfer lever.

For this purpose, the activation lever system and the transfer lever are connected to one another by joints. The coupling executed here is ensured on the one hand by the connection of joints and a spring connecting the activation lever system and the transfer lever on the other hand. The spring may be a leg spring which is connected to one of the (joint) bolts defining the joint connection.

Furthermore, a stop is usually provided for the transfer lever. This stop may be firmly situated in a latch case or a latch housing.

Due to the interplay between the stop and the spring for the springy mechanical connection of the activation lever system and the transfer lever it is ensured on the one hand that during normal activation and consequently "slow" impingement of the activation lever system of the transfer lever this movement can follow and the coupling is engaged accordingly compared to the activation lever system. As a consequence hereof, the transfer lever is initially unbolted and then used for the opening of the locking mechanism.

On the other hand "fast" impingement of the activation lever system (in the case of a crash) leads to the spring forces being overcome for the coupling of the activation lever system with the transfer lever and consequently the activation lever system executing the already described freewheeling vis-à-vis the transfer lever which remains in its "bolted" position. That is the desired functionality for representation of the crash safety and in order to prevent an unwanted opening of the locking mechanism.

Finally, it has proven especially auspicious if a center of mass of the transfer lever acting as a locking element and consequently a mass lock is arranged in the area of its rotational axis. The invention initially supposes the realization that the transfer lever can fundamentally accomplish pivoting movements around the rotational axis in question. Within the scope of the invention only certain pivoting movements are possible in conjunction with the fixed stop, as explained in further detail hereinafter with reference to the figure description.

As the center of mass of the transfer lever is arranged in the area of the rotational axis, on the one hand the transfer lever can pivot especially simply or by slight force and on the other hand solid designs of the transfer lever are unnecessary. Because such solidly constructed mass locks are typically (only) used where a shifting of the center away from the rotational axis is consciously necessary. However, as in accordance with the invention the center of mass is arranged in the area of the rotational axis, recourse can be had to a conventional or almost conventional design of the transfer lever, namely one in which the center of mass and the rotational axis coincide, as is the case in most multiple-arm pivoting levers. In fact, the transfer lever is designed as such a multiple-arm pivoting lever.

Thus, the motor vehicle door latch in accordance with the invention initially possesses a considerably reduced weight compared to the state of the art. Because the locking element or the mass lock is designed as a transfer lever in the present case, which is executed in the form of a multiple-arm lever with a center of mass in the area of its rotational axis.

This means that additionally exerted masses, an especially robust design, etc. are explicitly not necessary.

Added to this is that the transfer lever in accordance with the invention is respectively pivoted around its rotational axis during normal activation and also during bolting, i.e. the functional safety throughout the entire lifetime of the motor vehicle door latch can be safely guaranteed. A further advantage is that the transfer lever is only mechanically connected with the activation lever system by engagement of the coupling for opening of the locking mechanism in normal activation. This means that for an operator no significantly increased activation forces arise here as consistently observed in the state of the art in the active mass locks otherwise used. The fact that in accordance with the invention—as described—a solid design of the locking element or transfer lever can be dispensed with also contributes to this described low activation force.

A further and special advantage is that the locking element or the transfer lever are functionally integrated into the motor vehicle door latch so to speak and therefore represent no additional component which needs to be manufactured separately. Instead, the transfer lever functions comparably to a triggering lever for the locking mechanism. What is more, it is even conceivable for the transfer lever to undertake a total of three functions, namely the function of the locking element, the function of the triggering lever for the locking mechanism and finally the function of a bolting lever.

Because in the "bolted" position an impingement of the activation lever system does not lead to the locking mechanism being opened or the transfer lever—in its function as triggering lever—lifting the pawl from the catch either in normal activation or in the event of a crash respectively. This respectively assures the bolting unit which mechanically blocks the transfer lever in the "bolted" position. On the contrary, if the bolting unit is in the "unbolted" position and the transfer lever can consequently accomplish a free wheel vis-à-vis the coupling lever, normal activation corresponds to the transfer lever being engaged into the coupling vis-à-vis the activation lever system and—as a triggering lever—lifting the pawl from the catch with further activation of the activation lever system.

This means that the mechanism of action of the mass or centrifugal force lock or the associated locking element is integrated into the motor vehicle door latch so to speak and in the present case—if you wish—into a bolting lever chain or a bolting lever system. Because the transfer lever ultimately reflects the "unbolted" and "bolted" positions of the entire motor vehicle door latch in accordance with the invention.

By means of this integrated solution and the transfer of the mass lock to the bolting lever system an additional locking element which would need to be manufactured and installed additionally is ultimately dispensed with. Thus, considerable cost is saved and the weight of the motor vehicle door latch in accordance with the invention is significantly reduced compared to the previous execution forms. Furthermore, installation is simplified because the number of components is reduced which entails another cost advantage. In conjunction with the still guaranteed and safe functionality also viewed over the entire lifetime of the motor vehicle door latch special advantages are attained overall.

Hereinafter, the invention is explained in further detail on the basis of a sketch which only depicts an execution example. It shows:

DETAILED DESCRIPTION OF THE DRAWINGS

Figure 1:
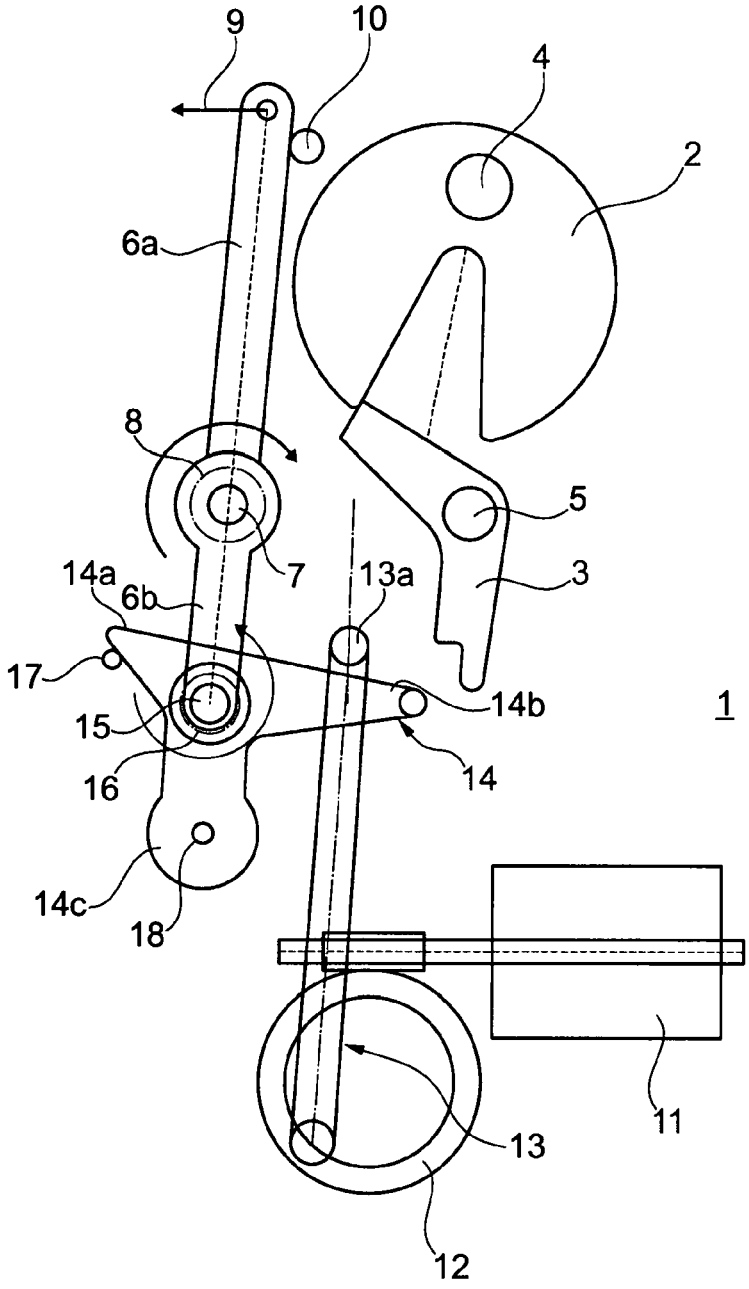
FIG. 1 a detailed overview of the motor vehicle door latch in accordance with the invention, FIG. 2A to 2C the object in accordance with FIG. 1 in the "unbolted" position 15 and with normal activation, FIG. 3A to 3C the object in accordance with FIG. 2A to 2C in the event of a crash and FIG. 4A to 4C the motor vehicle door latch in accordance with FIG. 1 in its "bolted" position 20 and a pertaining functional procedure.

In the figures a motor vehicle door latch is depicted which is reduced to the components crucial for the invention. A latch housing 1 is initially recognized which can be a latch case and/or a latch cover and which stores and accommodates the individual elements described in detail hereinafter. Furthermore, a locking mechanism 2, 3 is executed, which as known comprises a catch 2 and a pawl 3. The catch 2 is rotatably stored on a bolt defining a rotational axis 4 in the latch housing 1. The same applies to the pawl 3, which is rotatably housed in the lock housing 1 by a bolt defining a further rotational axis 5.

An activation lever system 6*a*, 6*b* works on the locking mechanism 2, 3. In the execution example the activation lever system 6*a*, 6*b* comprises two lever sections 6*a*, 6*b* of an external activation lever 6*a*, 6*b* connected by joints. The lever sections 6*a*, 6*b* are—as stated—connected by joints via a joint bolt 7 connecting them. A spring 8 is connected to the joint bolt 7.

The spring 8 is a leg spring 8, which tensions the two lever sections 6*a*, 6*b* with one another in such a way or connects them springily in such a way that with the aid of the spring 8 a force is applied in a clockwise direction with regard to the joint bolt 7, as indicated by a relevant arrow in FIG. 1. The force of the spring 8 therefore ultimately ensures that the lever section 6*a* is moved onto the lever section 6*b* with reduction of the angle spanned between them. In this context, a stop 10 for the rest position of the activation lever system 6*a*, 6*b* ensures that the two lever sections 6*a*, 6*b* act in this rest position like a universal lever or external activation lever 6*a*, 6*b*.

An external door handle 9 only indicated by an arrow is provided for for the impingement of the activation lever system 6*a*, 6*b* or the external activation lever 6*a*, 6*b*. The activation lever system 6*a*, 6*b* can fundamentally also be an internal activation lever system, instead of the external activation lever system depicted in the execution example. Then the external activation lever 6*a*, 6*b* is designed as an internal activation lever. However, this is shown just as little and for reasons of clarity, how the further procedure in accordance with which both an internal activation lever system and also an external activation lever system are generally implemented for such motor vehicle door latches.

In addition to this activation lever system 6*a*, 6*b* a bolting unit 11, 12 is executed. The bolting unit 11, 12 consists of an electrical motor 11 and a driven pulley 12 pivotable by the electrical motor 11 or its pinion shaft. With the aid of the electrical motor 11 the driven pulley 12 can be pivoted in rotations in a clockwise direction and an anti-clockwise direction. As a consequence hereof, a coupling lever 13 connected by joints to the driven pulley 12 can move in a linear manner. Essentially, two different basic settings of the coupling lever 13 are implemented and defined.

Figure 2A:
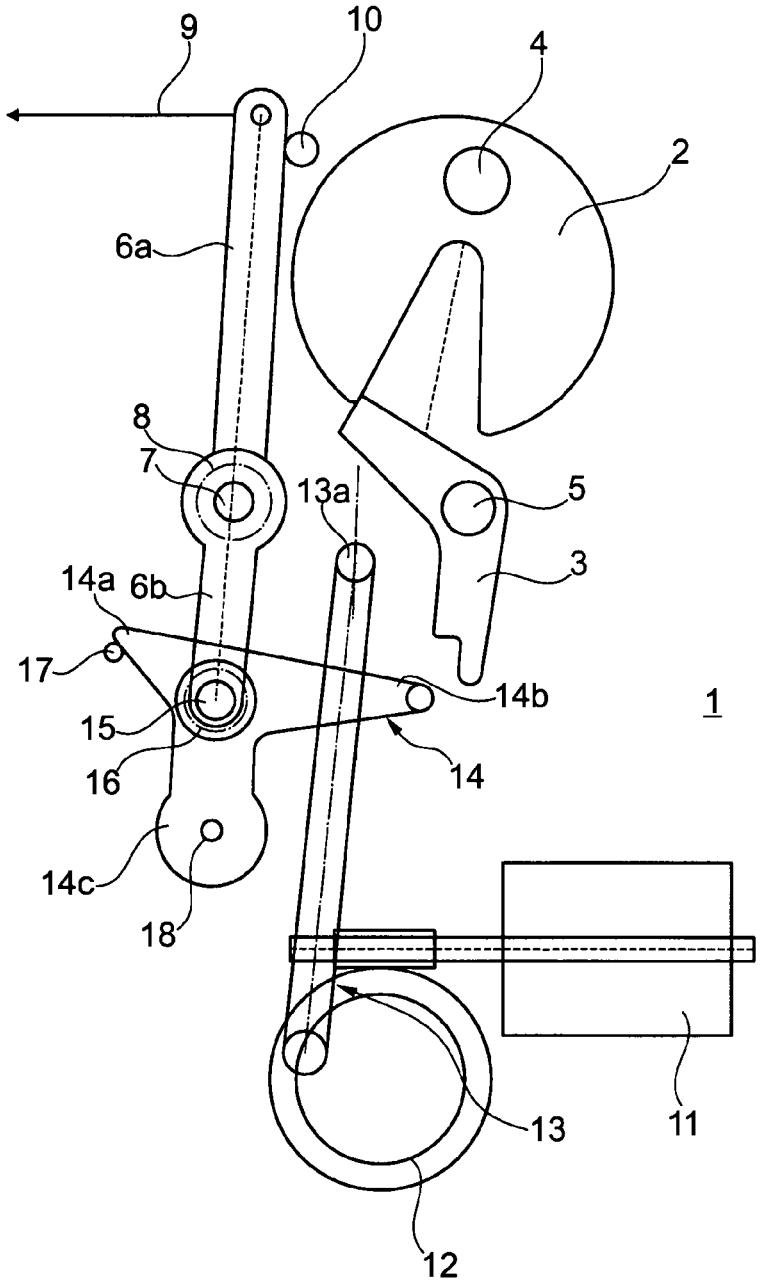
Figure 2B:
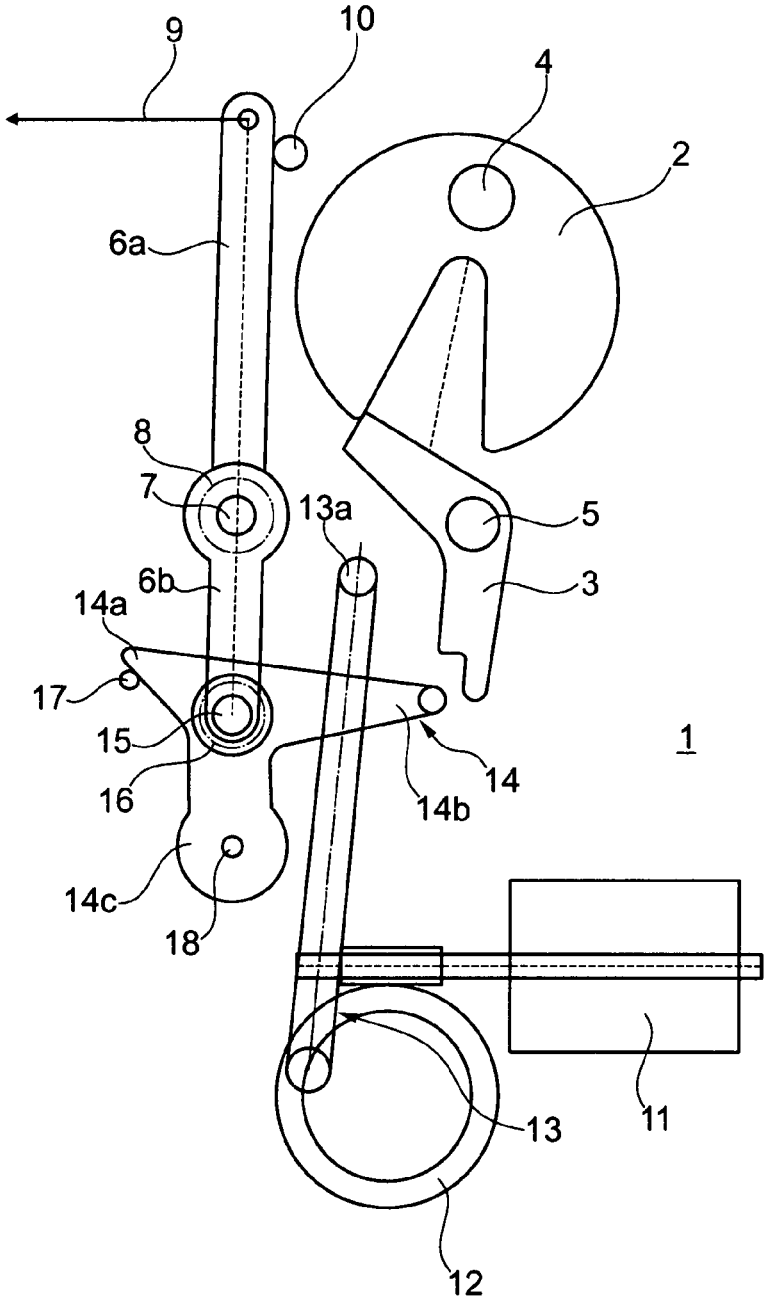
Figure 2C:
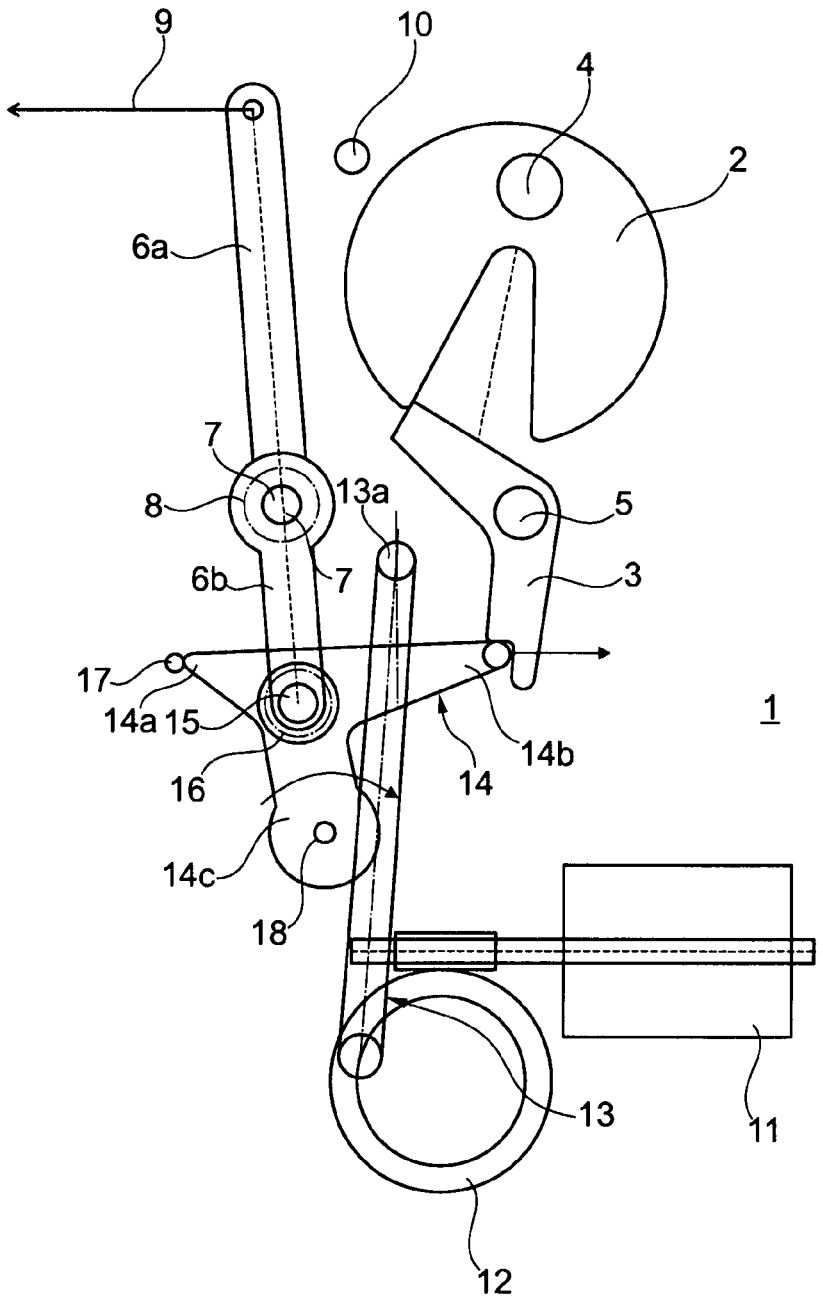
Figure 3A:
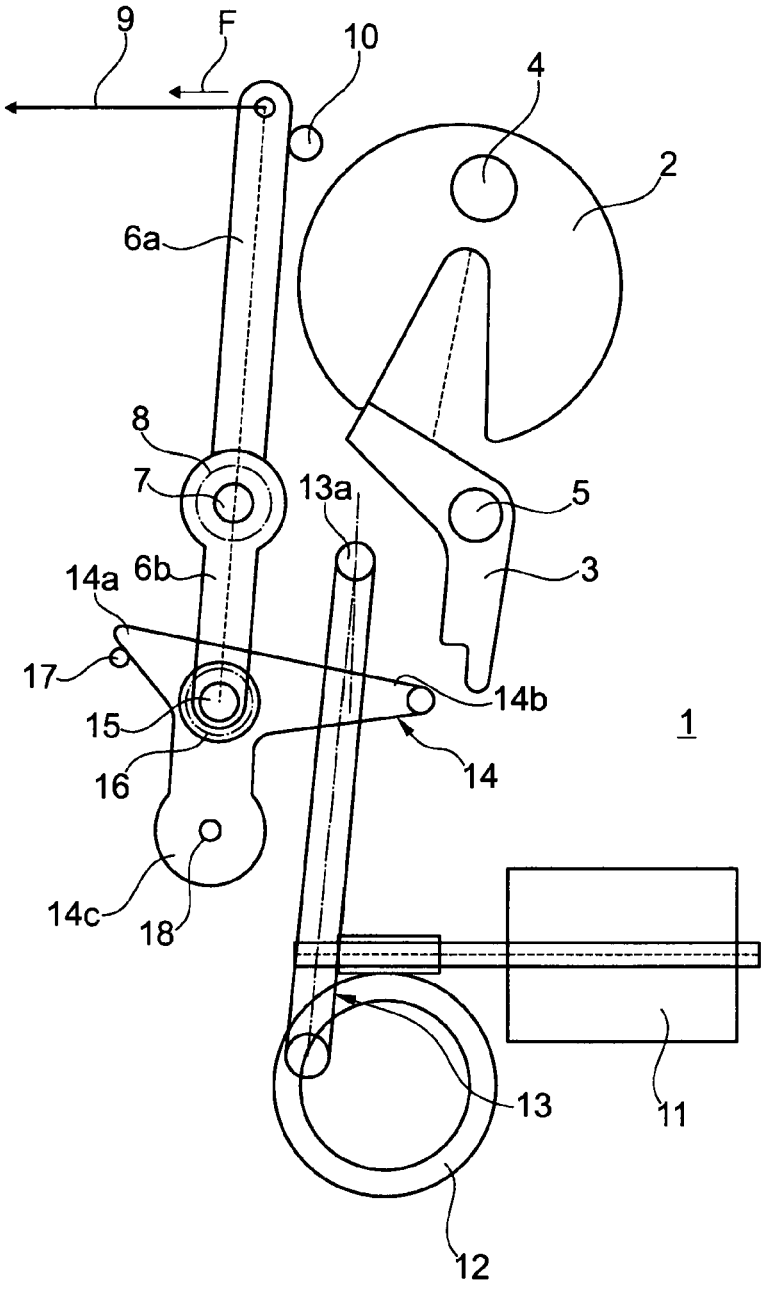
Figure 3B:
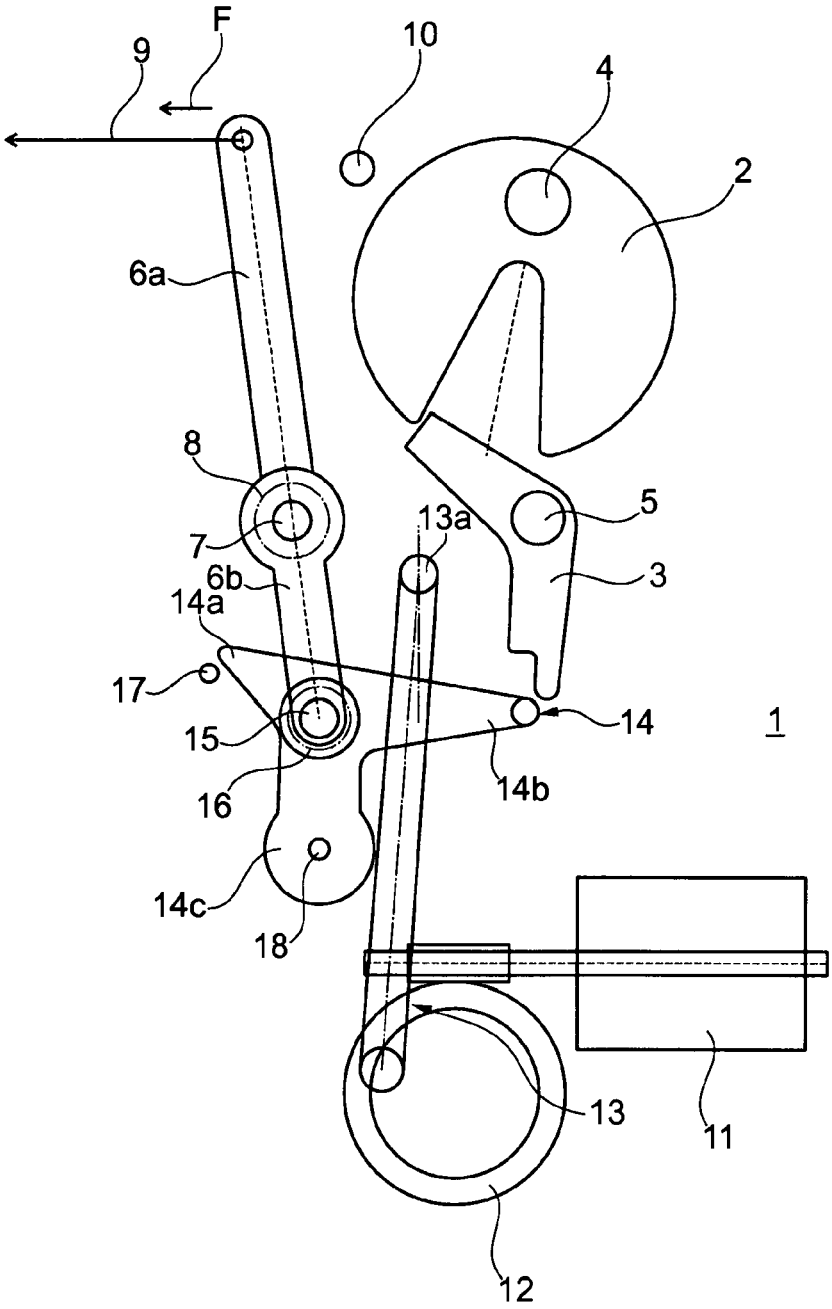
Figure 3C:
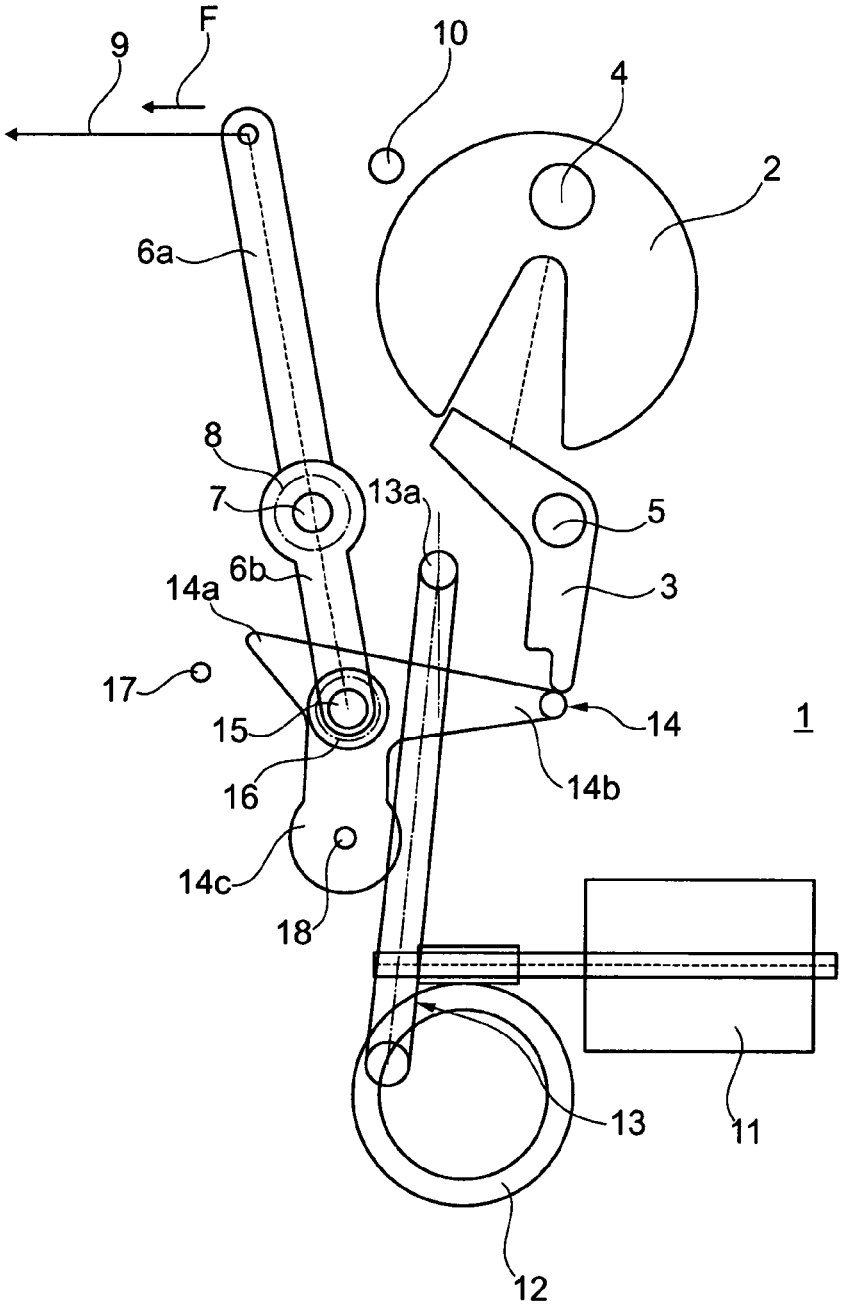

Thus, the position of the coupling lever 13 in FIG. 2A to 2C and in FIG. 3A to 3C belongs to the "unbolted" functional position of the bolting unit 11, 12. On the contrary, the position of the coupling lever 13 in FIG. 4A to 4C and in FIG. 1 belongs to the "bolted" functional position of the bolting unit 11, 12. In the "unbolted" position in accordance with FIGS. 2A to 2C and 3A to 3C a transfer lever 14 to be described in further detail below can accomplish a free wheel vis-à-vis the coupling lever 13. On the contrary, the relevant transfer lever 14 is respectively blocked in the "bolted" position of the bolting unit 11, 12 in accordance with the depictions in FIGS. 1 and 4A to 4C.

The previously discussed transfer lever 14 is a locking element 14 within the scope of the invention which disables the activation lever system 6*a*, 6*b* when acceleration forces F of a specified magnitude occur, for example in the event of an accident. The crash is depicted in FIG. 3A to 3C. Here it is recognized that although the acceleration forces F in question deflect the activation lever system 6*a*, 6*b* and distance themselves from the stop 10 for the rest position that such deflections of the activation lever system 6*a*, 6*b* correspond however to a freewheel of the activation lever system 6*a*, 6*b* vis-à-vis the transfer lever 14 remaining in its position, which consequently cannot open the locking mechanism 2,3 either directly or indirectly, as explained in further detail hereinafter.

As already described, in accordance with the invention the transfer lever 14 functions as a locking element 14 or mass lock and with the occurring acceleration forces F of a specified magnitude prevents unintentional opening of the motor vehicle door latch or a motor vehicle door equipped therewith. To this end, the locking element 14 is not only designed as a transfer lever 14, but the transfer lever 14 can also be impinged by the bolting unit 11, 12. Furthermore, the transfer lever 14 is arranged between the activation lever system 6*a*, 6*b* and the locking mechanism 2, 3.

In the execution example, the transfer lever 14 not only functions as a locking element 14 or mass lock, but ultimately also assumes the function of a triggering element or triggering lever, in such a way that with its help the locking mechanism 2, 3 can be directly or indirectly opened. To this end, the transfer lever 14 in its unbolted state and with so-called normal activation of the activation lever system 6*a*, 6*b* in the functional sequence in accordance with FIG. 2A to 2C at the end of the movement is able to lift the pawl 3 from the catch 2, as depicted in FIG. 2C.

Furthermore, the transfer lever 14 constitutes a component of a bolting lever chain 11, 12, 13, 14 so to speak. This bolting lever chain 11, 12, 13, 14 consists of the bolting unit 11, 12, the coupling lever 13 and the stated transfer lever 14. Consequently, the practically triple functionality of the transfer lever 14 already described at the start as a locking element 14 or mass lock, as a triggering lever for the locking mechanism 2, 3 and finally as a component of the bolting lever chain 11, 12, 13, 14 and thus as a type of bolting lever is declared.

In fact, the transfer lever 14 assumes the "bolted" position as a basic position. This basic position is depicted in FIG. 1, 2A, 3A to 3C and finally 4A to 4C. In contrast, the functional position in accordance with FIGS. 2B and 2C corresponds to the transfer lever 14 assuming or being able to assume the "unbolted" position, because in the functional sequence depicted in FIG. 2A to 2C the coupling lever 13 permits a freewheeling of the transfer lever 14, as explained in further detail hereinafter. Here a so-called normal activation is depicted, in which the activation lever system 6A, 6B initially transfers the transfer lever 14 into the "unbolted" position in accordance with FIG. 2B and then the transfer lever 14 coupled vis-à-vis the activation lever system 6A, 6B ultimately ensures the opening of the locking mechanism 2, 3 in accordance with the depiction in accordance with FIG. 2C.

In order to be able to implement this constructively, the activation lever system 6A, 6B or the external activation lever system 6A, 6B and the transfer lever 14 are joined to one another. In fact, a further joint bolt 15 is executed here. Furthermore, a spring 16 which is arranged on the joint bolt 15 or connected to the joint bolt 15. The spring 16 is a leg spring 16. With the help of the spring 16 the external activation lever 6*a*, 6*b* and the transfer lever 14 are mechanically coupled in such a way that the spring 16 generates a force indicated in FIG. 1 in an anti-clockwise direction with regard to the joint bolt 15. In the depiction in accordance with FIG. 1 a stop 17 for the transfer lever 14 ensures that the transfer lever 14 maintains its rest position or the "bolted" position shown there and is not pivoted by the spring force 16 in the direction on the external activation lever 6*a*, 6*b* in an anti-clockwise direction around the joint bolt 15 as a rotational axis 15.

Finally, it is recognized on the basis of FIG. 1 that the transfer lever 14 can be pivoted around a rotational axis 18 vis-à-vis the latch housing 1. The transfer lever 14 is designed as a three-armed lever in the present case, whereby the stop arm 14*a* of the transfer lever 14 is adjacent on the stop 15 in the rest position in accordance with FIG. 1. The triggering arm 14*b* ensures on the other hand within the scope of the functional position in accordance with FIG. 2C that with its help the pawl 3 is lifted from the catch 2 or the locking mechanism 2, 3 experiences an opening with normal activation. In addition to the stop arm 14*a* and the triggering arm 14*b* a rotary arm 14*c* of the transfer lever 14 is then provided for, which defines the rotational axis 18 and also demonstrates the center of gravity of the transfer lever 14 envisaged in the area of the rotational axis 18.

It operates as follows. In FIG. 2A to 2C the movement process during normal activation is depicted. In this normal activation, the external activation lever 6*a*, 6*b* is (slowly) pivoted by an operator in such a way that the operator impinges the external door handle 9 and thus pivots the external activation lever 6*a*, 6*b* during transition from FIG. 2A to FIG. 2B around the bolt or joint bolt 15 as a rotational axis 15 in an anti-clockwise direction. The bolting unit 11, 12 or the entire bolting chain 11, 12, 13, 14 is in its "unbolted" position during this normal activation. Consequently, as a result of the pivoting movement of the external activation lever 6*a*, 6*b* the transfer lever 14 engages into the activation lever system 6*a*, 6*b*.

In other words, the pivoting movement of the external activation lever 6*a*, 6*b* in an anti-clockwise direction around the axis 15 initiated by the operator or user ensures that the transfer lever 14 is "taken along" in this process because the external activation lever 6*a*, 6*b* on the one hand and the transfer lever 14 on the other hand are mechanically connected by the spring 16 pre-stressed in the direction of this anti-clockwise direction movement. This means that the transfer lever 14 is engaged in this process vis-à-vis the activation lever system 6*a*, 6*b*.

As a consequence hereof, the transfer lever 14 is also pivoted around its axis 18 in an anti-clockwise direction and accordingly leaves its "bolted" position in accordance with FIG. 2A and on the other hand transfers into an "unbolted" position in accordance with FIG. 2B. Such a movement is permitted because the bolting unit 11, 12 is also in its "unbolted" position and the coupling lever 13 permits relevant freewheeling of the transfer lever 14 vis-à-vis the coupling lever 13 or a bolt 13*a* there.

Further movement of the external activation lever 6*a*, 6*b* in an anti-clockwise direction and the anti-clockwise direction movement of the transfer lever 14 around the axis 18 also initiated as a result now result in the stop arm 14*a* of the transfer lever 14 gliding along the stop 17 and finally a further pivoting movement of the external activation lever 6*a*, 6*b* leading to the transfer lever 14 accomplishing a slight pivoting movement in a clockwise direction around the axis 18 in the functional setting in accordance with FIG. 2C as a result of the position on the stop 17 which corresponds to the pawl 3 being lifted from the catch 2. This is depicted by a relevant arrow in FIG. 2C. This means that at the end of the functional sequence in accordance with FIG. 2A to 2C during normal activation and for the bolting unit 11, 12 in the "unbolted" position the triggering arm 14*b* of the transfer lever 14 finally functions like a triggering element working on the locking mechanism 2, 3 or a relevant triggering lever.

In the figure sequence in accordance with FIG. 3A to 3C the occurrence of acceleration forces F of a specified magnitude is now therefore depicted the crash in the "unbolted" position of the bolting unit 11, 12. This means that the coupling element 13 has maintained its position in comparison to the functional sequence in accordance with FIG. 2A to 2C in comparison to the transfer lever 14. Thus, in principle the transfer lever 14 can accomplish a freewheel compared to the coupling lever 13 in principle, consequently its basic "bolted" position assumed in the depiction in accordance with FIG. 3A is left. However, this does not occur for the reasons outlined below.

Because the occurring acceleration forces F of a specified magnitude in the event of a crash ensure that once again—as during normal activation—the external activation lever 6*a*, 6*b* or the activation lever system 6*a*, 6*b* accomplishes an anti-clockwise direction movement around the axis or in relation to the joint bolt 15. However, in this process the transfer lever 14 is unable to follow the rapid movement of the activation lever system or the external activation lever 6*a*, 6*b* due to its mass inertia. Instead, the transfer lever 14 remains in the "bolted" position in accordance with FIG. 3A due to its mass inertia. This means that during the deflection of the external activation lever 6*a*, 6*b* during transition to FIGS. 3B and 3C the transfer lever 14 retains its originally assumed "bolted" position in accordance with FIG. 3A.

Thus, the external activation lever 6*a*, 6*b* is distanced from its stop 10 for the rest position without being able to take the transfer lever 14 with it. Consequently, the triggering arm 14*b* of the transfer lever 14 is unable to be able to interact with the pawl 3 in the opening sense, as becomes clear with maximum deflection of the activation lever system 6*a*, 6*b* in accordance with the depiction in accordance with FIG. 3C. This means that due to the mass inertia of the locking element or the transfer lever 14 the activation lever system 6*a*, 6*b* is disabled with the occurring acceleration forces F of a specified magnitude and in the present case accomplishes a freewheel vis-à-vis the relevant locking element or transfer lever 14.

Figure 4A:
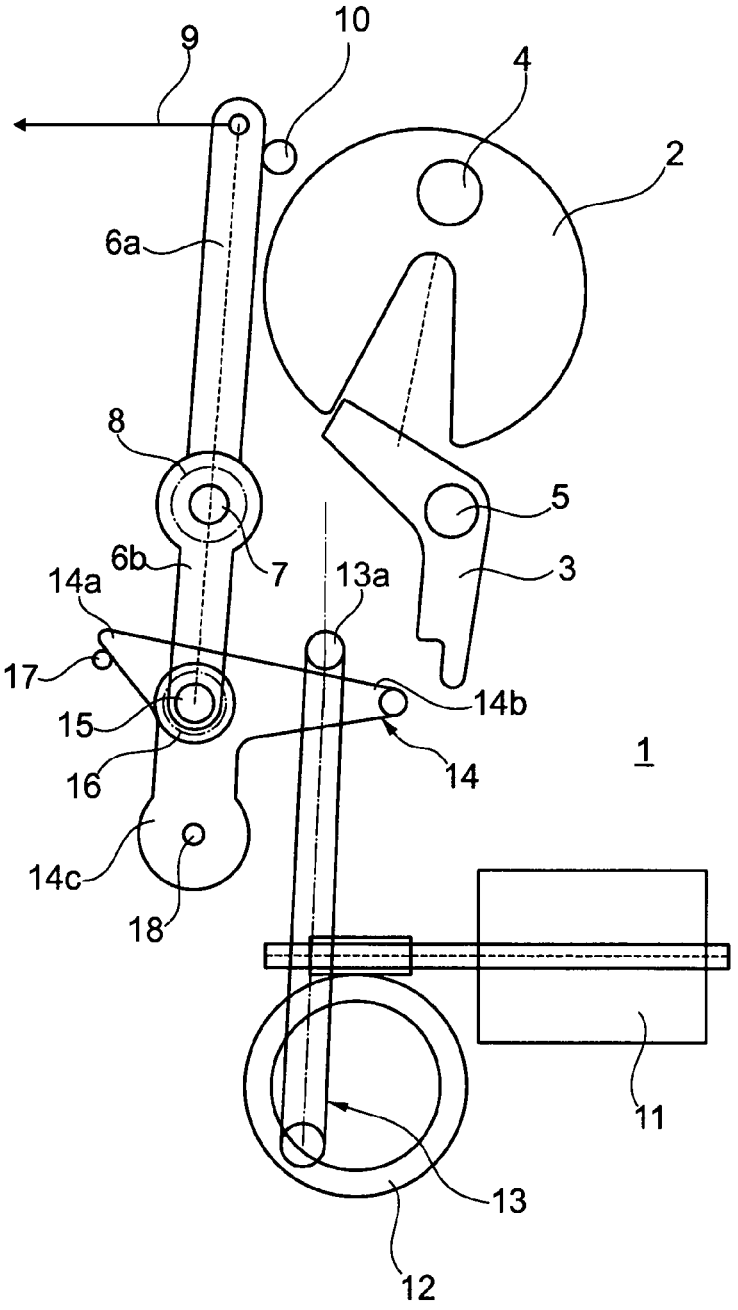
Figure 4B:
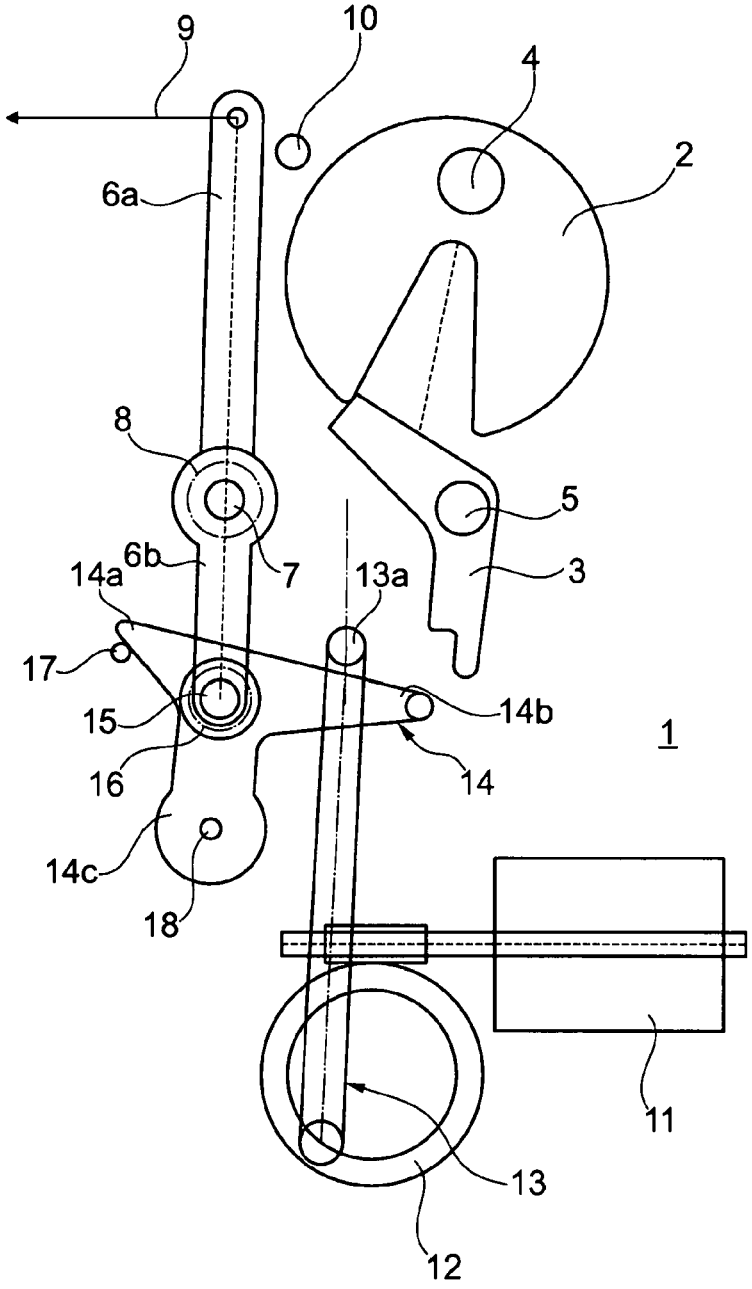
Figure 4C:
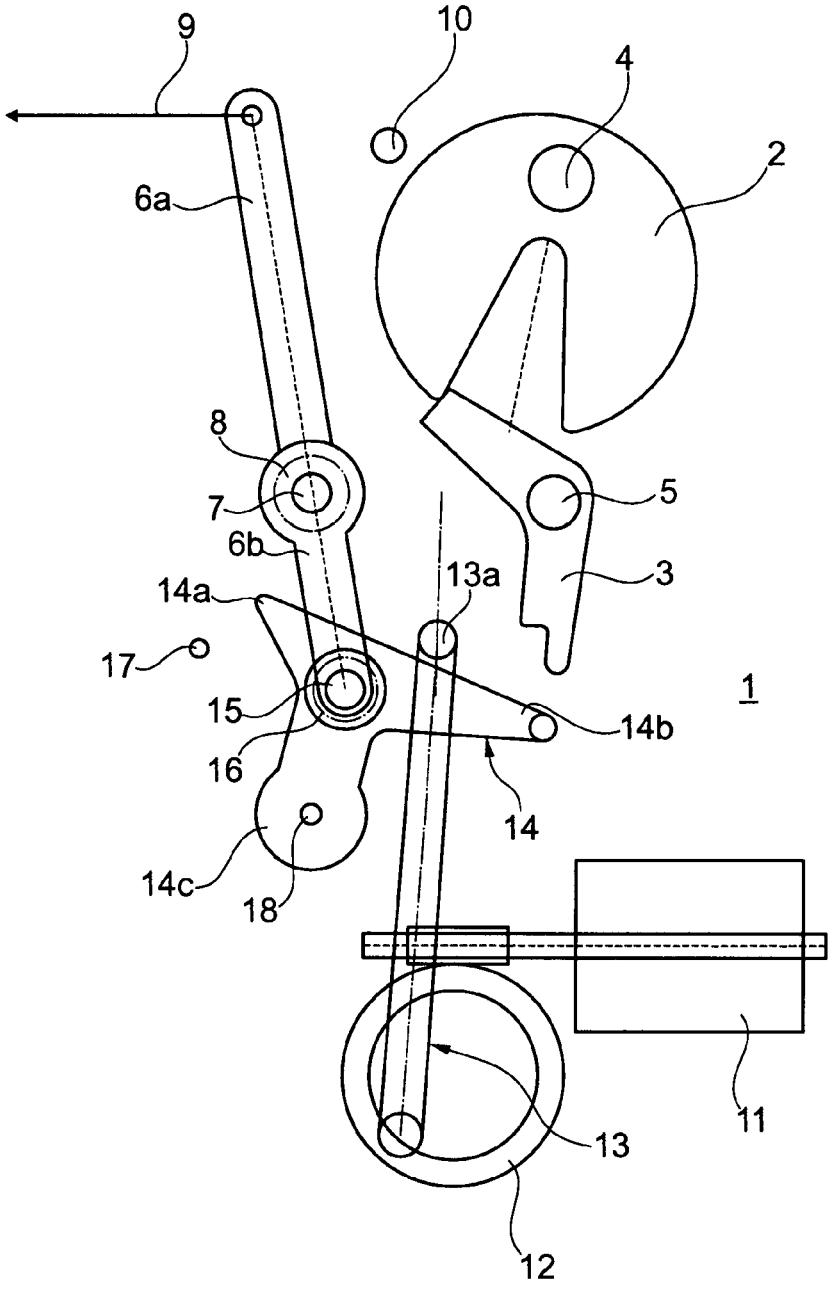

In FIG. 4A to 4C finally the scenario is depicted in which the bolting unit 11, 12 and consequently the motor vehicle door latch overall is located in the "bolted" position. The transfer lever 14 is blocked in this position with the aid of the coupling lever 13. Because the coupling lever 13 with its bolt 13*a* ensures that this bolt 13*a* holds the triggering arm 14*b* of the transfer lever 14 firm and accordingly the transfer lever 14 cannot accomplish any pivoting movements in an anti-clockwise direction in this "bolted" position, as would be necessary for the unbolting and finally opening of the locking mechanism 2, 3 in accordance with the functional sequence in accordance with FIG. 2A to 2C.

In fact, in the "bolted" position the transfer lever 14 is fixed with the aid of the stop on the one hand 17 for the rest position of the transfer lever 14 and on the other hand with the aid of the bolt 13*a* to the coupling lever 13 in such a way that the transfer lever 14 cannot be pivoted into the "unbolted" position by means of an anti-clockwise direction movement around its axis 18.

As a consequence hereof, an impingement of the activation lever system or external activation lever 6*a*, 6*b* by an operator due to relevant pulling movements on the external door handle 9 again leads to the activation lever system or the external activation lever 6*a*, 6*b* accomplishing an empty movement vis-à-vis the transfer lever 14. Even if the external activation lever 6*a*, 6*b* has completed its maximum path, as already depicted in the event of a crash in FIG. 3C and FIG. 4C shows, a subsequent rotation in a clockwise direction of the transfer lever 14 around its rotational axis 18 then does not lead to the triggering arm 14*b* of the transfer lever 14 moving into the effective range of the pawl 3.

This means that this movement in a clockwise direction of the transfer lever 14 around the rotational axis 18 observed in accordance with FIG. 2C at the end of normal activation in the "unbolted" position does not lead in the "bolted" position to the triggering arm 14*b* travelling against the pawl 3. Because the coupling lever 13 or its bolt 13*a* ensures that the transfer lever 14 is held outside of the effective range of the pawl 3 and consequently the impingement of the pawl 3 by the triggering arm 14*b* of the transfer lever 14 depicted in FIG. 2C when the locking mechanism 2, 3 is opened cannot take place. This means that the usual "bolted" functionality is depicted and in this context the activation lever system 6*a*, 6*b* executes a desired return stroke.

The invention claimed is:

1. A motor vehicle door latch, comprising:

a locking mechanism comprising a catch and a pawl arranged to retain the catch in a closed position;

an activation lever system operationally coupled to a handle;

a transfer lever, coupled to the activation lever system, wherein the transfer lever is arranged to release the pawl from the catch to allow the catch to open;

a bolting unit including a driven pulley and a coupling lever comprising a first end pivotally connected to the driven pulley and a second end that extends away from the driven pulley, wherein the transfer lever and the bolting unit act as a locking element which disables the activation lever system upon acceleration forces of a specified magnitude; and wherein the coupling lever is movable upon operation of the driven pulley to move between a bolted position in which the coupling lever blocks the transfer lever from releasing the pawl and an unbolted position in which the coupling lever does not block to the transfer lever from releasing the pawl.

2. The motor vehicle door latch in accordance with claim 1, wherein the bolting unit mechanically blocks the transfer lever in the "bolted" position.

3. The motor vehicle door latch in accordance with claim 2, wherein the bolting unit facilitates a freewheel for the transfer lever in the "unbolted" position.

4. The motor vehicle door latch in accordance with claim 3, wherein the transfer lever assumes the "bolted" position as its basic position.

5. The motor vehicle door latch in accordance with claim 3, wherein the activation lever system and the transfer lever are rotatably connected to one another at a joint.

6. The motor vehicle door latch in accordance with claim 5, wherein the transfer lever is pre-tensioned relative to the activation lever system by means of a spring.

7. The motor vehicle door latch in accordance with claim 6, wherein the center of mass of the transfer lever is arranged in the area of its rotational axis.

8. The motor vehicle door latch in accordance with claim 1, wherein the bolting unit facilitates a freewheel for the transfer lever in the "unbolted" position.

9. The motor vehicle door latch in accordance with claim 8, wherein the transfer lever assumes the "bolted" position as its basic position.

10. The motor vehicle door latch in accordance with claim 1, wherein the transfer lever assumes the "bolted" position as its basic position.

11. The motor vehicle door latch in accordance with claim 1, wherein the activation lever system and the transfer lever are rotatably connected to one another by joints.

12. The motor vehicle door latch in accordance with claim 1, wherein the transfer lever is pre-tensioned relative to the activation lever system by means of a spring.

13. The motor vehicle door latch in accordance with claim 1, wherein the center of mass of the transfer lever is arranged in the area of its rotational axis.

14. The motor vehicle door latch in accordance with claim 1, wherein the second end of the coupling lever moves in a linear manner when the driven pulley rotates.

15. The motor vehicle door latch in accordance with claim 1, wherein the activation lever is pivotably coupled to the transfer lever at a joint.

16. The motor vehicle door latch in accordance with claim 15, further comprising a spring that biases the transfer lever to move with the activation lever due to a biasing force of the spring.

17. The motor vehicle door latch in accordance with claim 15, wherein the transfer lever rotates about an axis that is offset from the joint.

* * * * *